US007575138B2

(12) United States Patent
Lindberg

(10) Patent No.: US 7,575,138 B2
(45) Date of Patent: Aug. 18, 2009

(54) SKI AND SKI BOOT BACKPACK

(76) Inventor: Mary Manley Lindberg, 38 Station Rd., Cranbury, NJ (US) 08512

( * ) Notice: Subject to any disclaimer, the term of this patent is extended or adjusted under 35 U.S.C. 154(b) by 419 days.

(21) Appl. No.: 11/424,984

(22) Filed: Jun. 19, 2006

(65) Prior Publication Data

US 2006/0289588 A1 Dec. 28, 2006

Related U.S. Application Data

(60) Provisional application No. 60/693,471, filed on Jun. 23, 2005.

(51) Int. Cl.
*A45F 3/04* (2006.01)

(52) U.S. Cl. ..... 224/645; 224/647; 224/652

(58) Field of Classification Search ..... 224/645, 224/647, 652, 655, 578, 579, 580
See application file for complete search history.

(56) References Cited

U.S. PATENT DOCUMENTS

| | | | | |
|---|---|---|---|---|
| 4,248,365 | A | 2/1981 | Jacobs | |
| 4,358,137 | A * | 11/1982 | Gramm | 280/814 |
| 4,744,398 | A * | 5/1988 | Clark | 224/153 |
| 4,955,519 | A | 9/1990 | Forrester | |
| 5,012,921 | A | 5/1991 | Becker | |
| D352,603 | S | 11/1994 | Maller | |
| 5,538,137 | A | 7/1996 | Deioma et al. | |
| 5,560,665 | A | 10/1996 | Kelley | |
| 5,758,770 | A | 6/1998 | Moneta | |
| 5,881,708 | A | 3/1999 | Kliot | |
| D428,249 | S * | 7/2000 | Ash, Jr. | D3/217 |
| 2002/0113102 | A1 * | 8/2002 | Klamm | 224/153 |

* cited by examiner

*Primary Examiner*—Nathan J Newhouse
*Assistant Examiner*—Lester L Vanterpool
(74) *Attorney, Agent, or Firm*—Richard C. Woodbridge; Frank T. Carroll; Fox Rothschild, LLP

(57) ABSTRACT

A backpack, intended for a child, can accommodate the ski boots, ski poles, skis or a snow board. The backpack has a long narrow top to accommodate the skis and ski poles, and a wider base to accommodate the ski boots, and a pair of shoulder straps also attached to the bottom section. A bag is provided so that the entire backpack can be stored and carried from location to location. The bag also doubles as a helmet holder and is attachable to the long top section of the backpack when ski equipment is carried. A fabric flap is attached to the bottom section of the backpack opposite from the shoulder straps. The top section can be rolled up, or folded down, into the flap so that the backpack can double as a normal backpack when not used for carrying ski equipment.

8 Claims, 7 Drawing Sheets

SKI AND SKI BOOT BACKPACK

CROSS-REFERENCE TO RELATED APPLICATIONS

This application claims the priority of provisional U.S. Provisional Application Ser. No. 60/693,471, filed on Jun. 23, 2005 and entitled "Ski and Ski Boot Backpack" by Mary Lindberg, the entire contents and substance of which are hereby incorporated in total by reference.

BACKGROUND OF THE INVENTION

1. Field of the Invention

The invention relates to a backpack, preferably for a child, which when unfolded can accommodate skis, ski poles, snow boards and/or ski boots and, when in the folded state can also double as a normal backpack.

2. Description of Related Art

Backpacks are fairly well-known in the prior art and patent literature as are devices for carrying skis and ski boots, however, there are very few devices that permit a user to carry his or her ski equipment on his or her back. It is generally easier for adults to carry ski equipment because they are bigger and taller. Accordingly, numerous ski and ski boot holders are intended for manual gripping. Unfortunately, this is not possible for a child or adolescent because the child cannot carry the same amount of weight as an adult and, because the child's arms are shorter and closer to the ground, the child cannot carry the ski and ski boots without dragging them on the ground. Accordingly, a need was identified for a device that would permit a child to carry his or her own ski equipment in such a way that the child can safely bare the weight of the equipment and the equipment does not drag on the ground.

Perhaps the most relevant prior art may be disclosed in U.S. Pat. No. 5,881,708, entitled "Backpack for Heavy Bulky Footwear" by Eugene N. Kliot. That disclosure teaches a backpack for carrying heavy, bulky footwear such as rollerblades, roller skates, ice skates or ski boots and can accommodate long articles such as skis or a snow board on the outside. In particular, the disclosure shows the use of the invention with a snowboard. Unfortunately, the snowboard extends substantially above and below the pack making it difficult for a child to carry much less sit down with the pack on. U.S. Pat. No. 5,881,708 does not concern the issue that skis have sharp edges, that the poles are pointy and that when attached to the outside of the bag there is the possibility that: a) the equipment could slide off the bag; b) the equipment is exposed and could rub against the child's clothing which could rip the clothing; c) the equipment could be dangerous if it banged against the child's body; and, d) if the equipment is wet from the snow, it would drip onto the child's clothing.

Another interesting approach is described in U.S. Pat. No. 4,358,137, entitled "Carrier for Ski Equipment" by inventor Raymond J. Gramm. That invention comprises an elongated zippered bag which can accommodate skis, ski poles and boots. A pair of wheels is located on the bottom of the bag so that the bag can be dragged or rolled along a relatively flat surface. If the carrier is pulled, it may not travel well over snow, mud or water and may be difficult to carry onto a wagon when going from the parking lot to the ski lodge. It also requires a hand to pull the bag. When traveling with children, this may not be safe, especially with more than one child when it is important to hold hands while walking together.

U.S. Design Pat. No. D352,603, entitled "Combined Ski and Boot Carrier" teaches an ornamental design for a combined ski and boot carrier which apparently includes straps for carrying on a person's back.

U.S. Pat. No. 5,560,665, entitled "Compact Lightweight Foldable Ski Equipment Carrier" describes an equipment carrier, including a handle strap, which can be folded up when not in use as an equipment carrier.

U.S. Pat. No. 5,758,770, entitled "Combined Personal Transport and Storage Case for a Single Set of Ski Equipment" describes an elongated package intended for carrying by hand.

U.S. Pat. No. 4,955,519, entitled "Ski Case Sled" describes a device intended for use as a sled for carrying ski equipment including snow boards, cross county skis, etc.

Lastly, the following patents are all cited as showing the general state of the art, in particular, the art related to cases for carrying ski equipment wherein the cases include hand grips for hand carrying the same: U.S. Pat. Nos. 4,248,365; 5,012,921; and, 5,538,137.

In view of the foregoing, it is clear that there is a need for a backpack which will permit a child to carry all of his or her own ski equipment including skis, ski boots and ski poles in a manner that is safe. In particular, the bag should be self-contained for the child's safety. The skis, boots, poles should not be free to swing or bank into anyone or anything. Also, the backpack should allow the child's hands to be free to hold an adult's hand or a railing.

It was in the context of the foregoing prior art that the present invention arose.

SUMMARY OF THE INVENTION

Briefly described, the invention comprises a backpack that permits a child to carry all of his or her own ski equipment including skis, ski poles, ski boots, or snow boards and snow board boots, helmet, goggles and ski lock. The backpack in its totally folded state fits neatly into a storage carrying bag which includes a hand-hold strap and a pair of clips. When the carrying bag is open, the backpack can be removed and unfolded. When unfolded the backpack has a long, narrow top, or upper section, and a wide, broader bottom section. The weight of the equipment is located at the base of the backpack for stability. A zipper which can be opened from either the top or bottom of the backpack permits the user to access the inside of the backpack. The backpack can accommodate skis or a snow board, ski poles, and ski or snow board boots. In addition the storage carrying bag doubles as a ski helmet, goggles, ski lock carrier which can be clipped onto the upper section of the backpack when it is used for conveying skis. The backpack includes an extra flap, or pocket, located on the bottom section of the back and a second set of shoulder straps which are located on the lower section of the backpack on the front of the backpack. When the skis, ski poles or snow board is removed, the top section of the backpack can be rolled down into the pocket so that the proportionality of the backpack functions to allow the child to comfortably carry their ski or snow board boots. When the child is completely finished skiing, he or she can roll the backpack up all the way and return the backpack to the carrying bag. However, the backpack can also be used to store ski or snow board equipment when not skiing. The backpack has a strap on the top so that the backpack, when filled with equipment, can be hung in the basement or garage for the off-season.

These and other features of the invention will be more fully understood by reference to the following drawings.

DETAILED DESCRIPTION OF THE PREFRRED EMBODIMENT

During the course of this description like numbers will be used to identify like elements according to the different views that illustrate the invention.

Figure 1A:
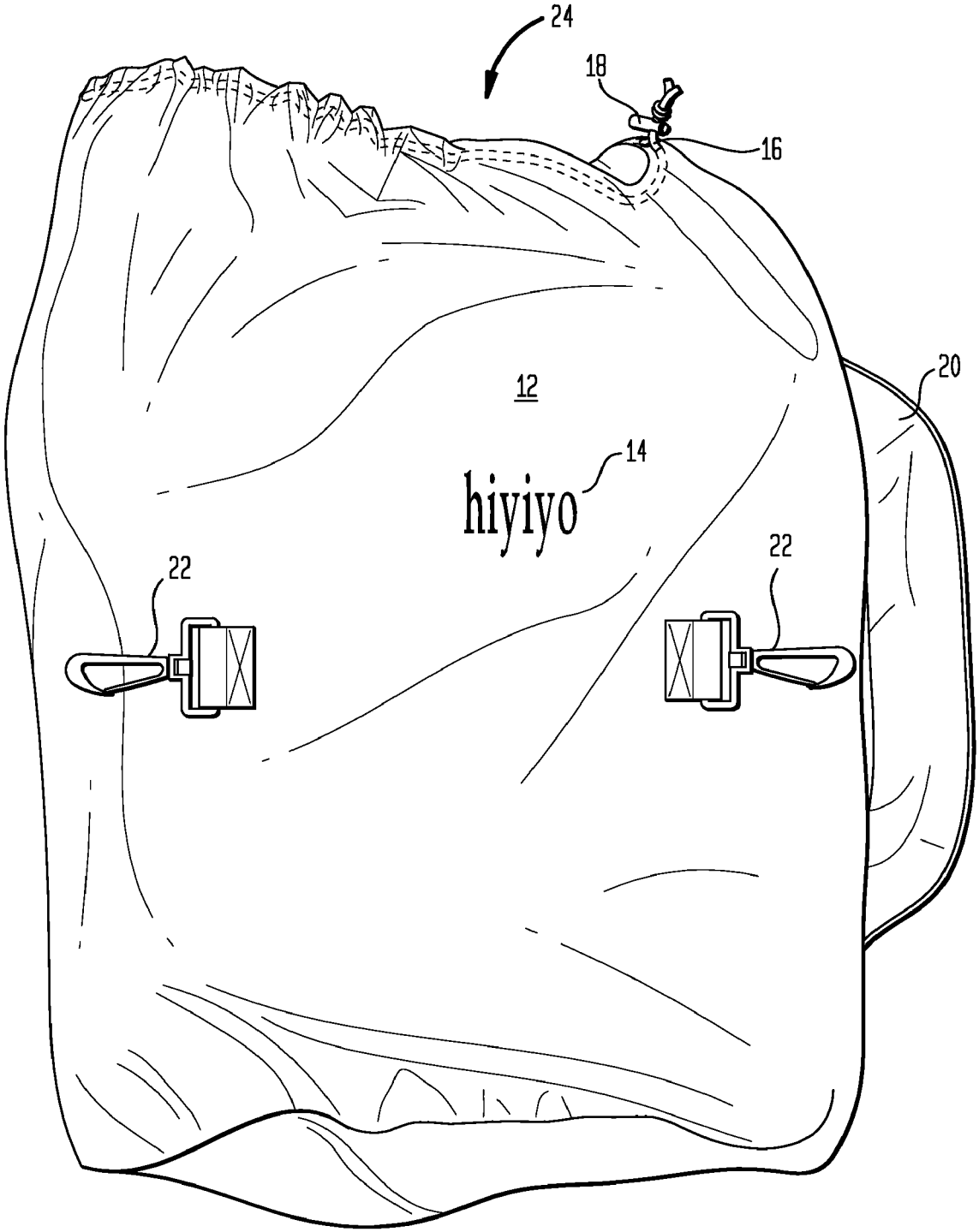
FIG. 1A illustrates the preferred embodiment of the invention when completely rolled up and stored in its storage carrying bag.
Figure 3A:
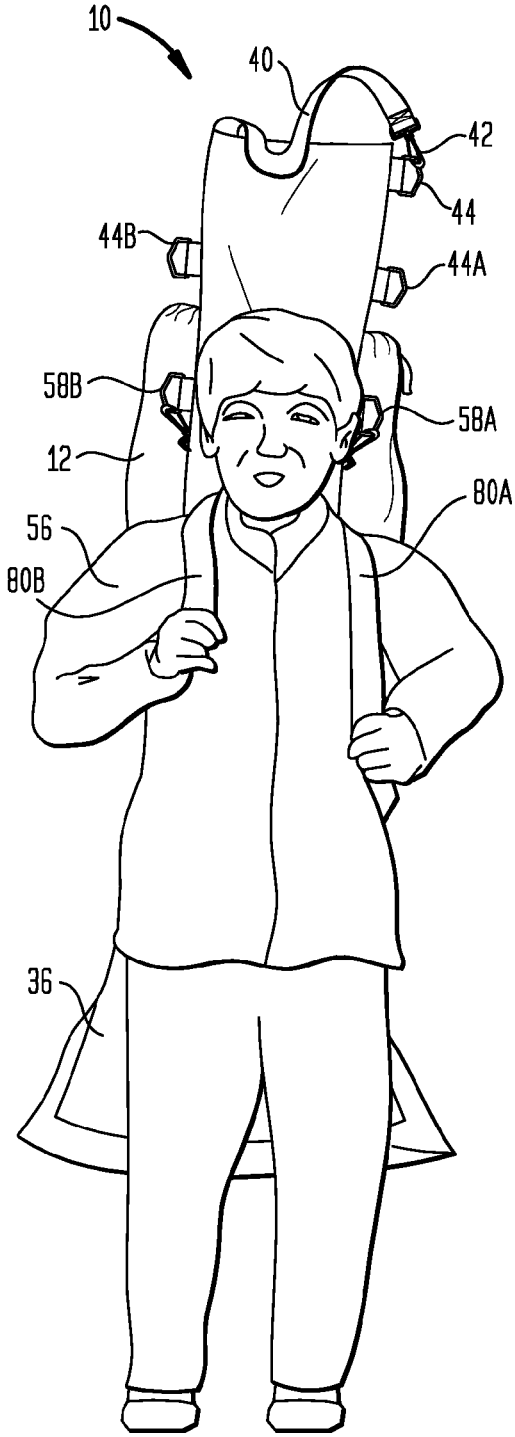
FIG. 3A is a front view of a child wearing a backpack including skis, ski boots, and ski poles.
Figure 3B:
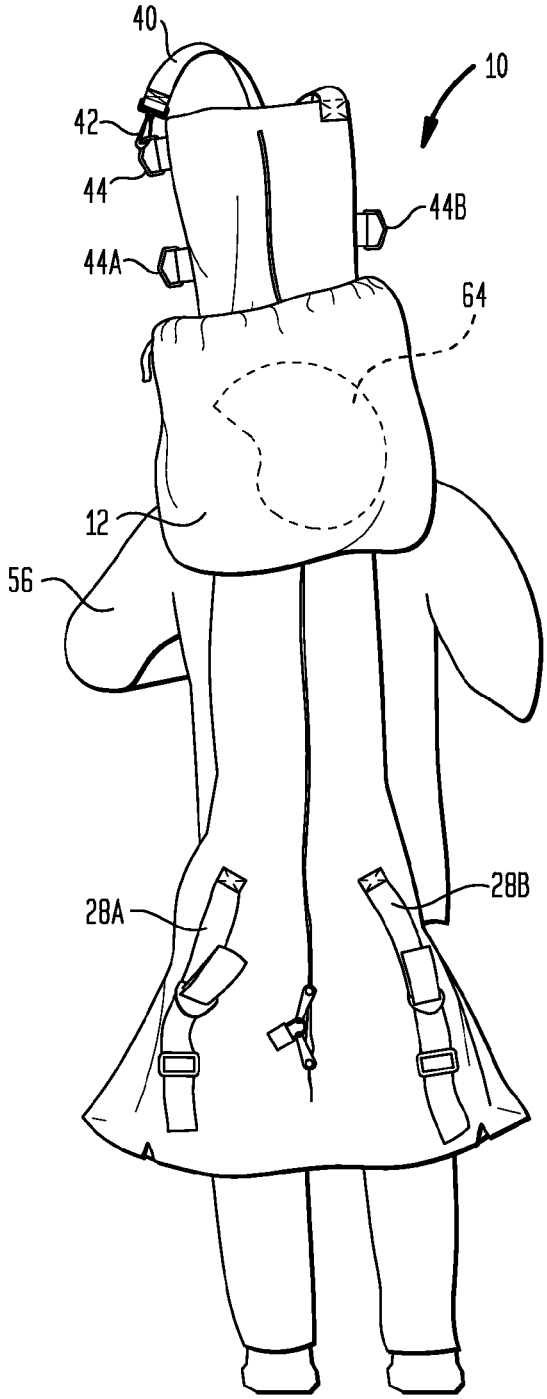
FIG. 3B is a rear view of the child and backpack shown in FIG. 3A and including the storage bag, which holds a ski helmet, shown clipped to the upper section of the backpack.

The invention 10, according to the preferred embodiment of the invention, is preferably stored in a storage/carrying bag 12, when not in use and when it's in its fully folded state, as shown in FIG. 1A. Storage bag 12 might include a place for a logo 14 if the product is branded. A drawstring 16 including a conventional commercial drawstring lock 18 is provided so that the storage bag 12 can be easily opened or closed. When the drawstring lock 18 is unlocked, the storage bag 12 can be opened to reveal opening 24. The backpack invention 10 is easily inserted into bag opening 24 when the invention 10 is in its fully folded or rolled up state. Storage bag 12 also includes a hand carrying strap 20 and a pair of clips 22. Storage bag 12 also conveniently doubles as a carrying bag for a ski helmet 64 shown in phantom in FIG. 3B. In this mode, the clips 22 are employed to engage with D-rings 44A and 44B or 58A and 58B so that the ski helmet 64 can be easily carried by a child 56 as shown in FIGS. 3A and 3B. A child 56 would probably use the lower D-rings 58A and 58B in order to avoid becoming top heavy while an adult would be more likely to use the upper D-rings 44A and 44B.

Figure 1B:
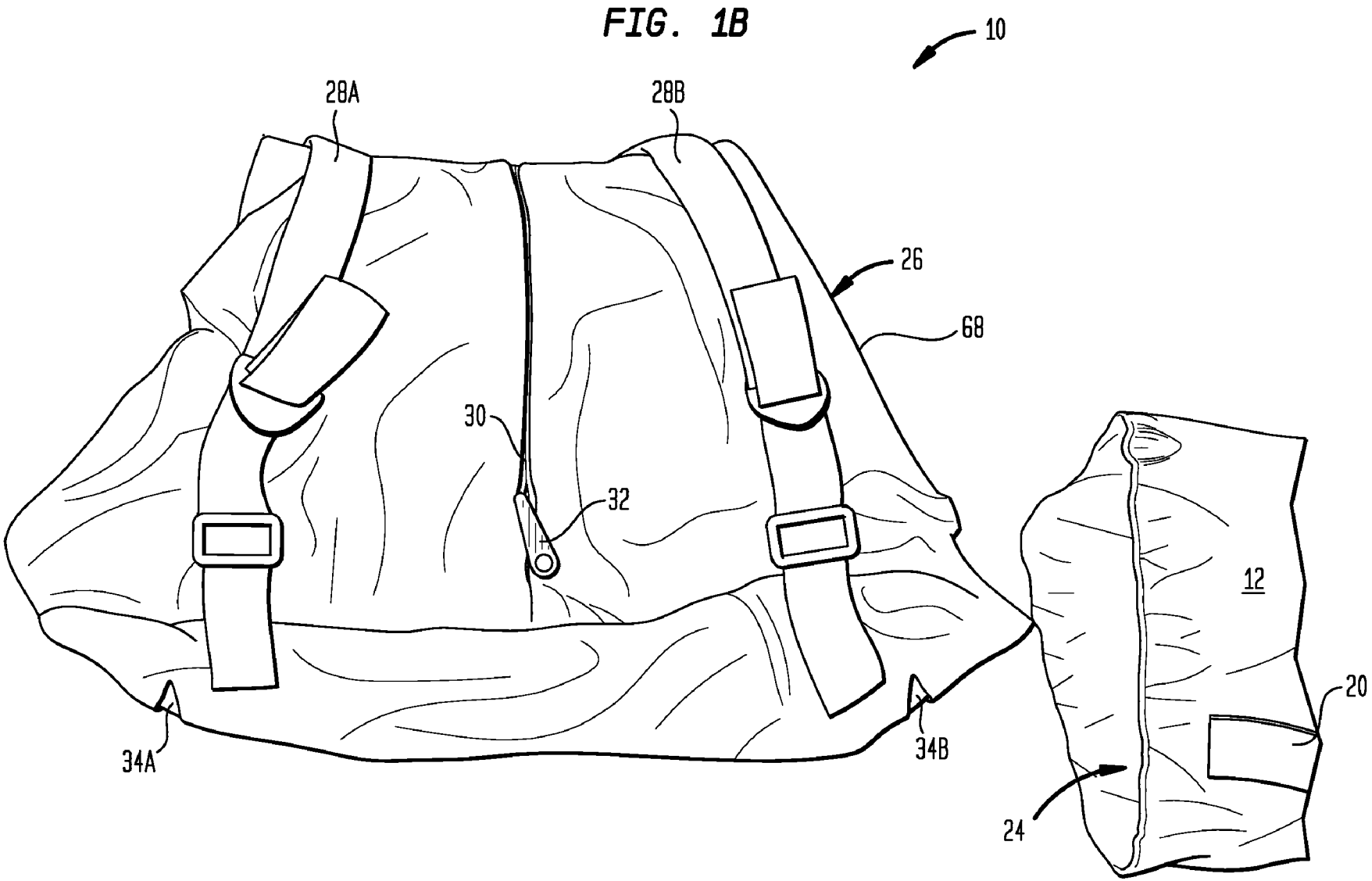
FIG. 1B is a rear view of the partially unfolded backpack according to the preferred invention after it has been removed from its storage bag.

Backpack 10, according to the preferred embodiment of the invention, is shown from the rear side in its partially unfolded mode 26 in FIG. 1B. Backpack shoulder straps 28A and 28B are shown on opposite sides of the broad base section 68. A zipper 30 connected to a zipper pull 32 are located in the center. The zipper 30 extends from the lower section 68 to the narrow top section 66 shown in FIGS. 1D and 1E. A pair of grommet drain hole openings 34A and 34B are located at the bottom of the base section 68 to permit melting snow, ice and water to drain through the backpack 10 without accumulating.

Figure 1C:
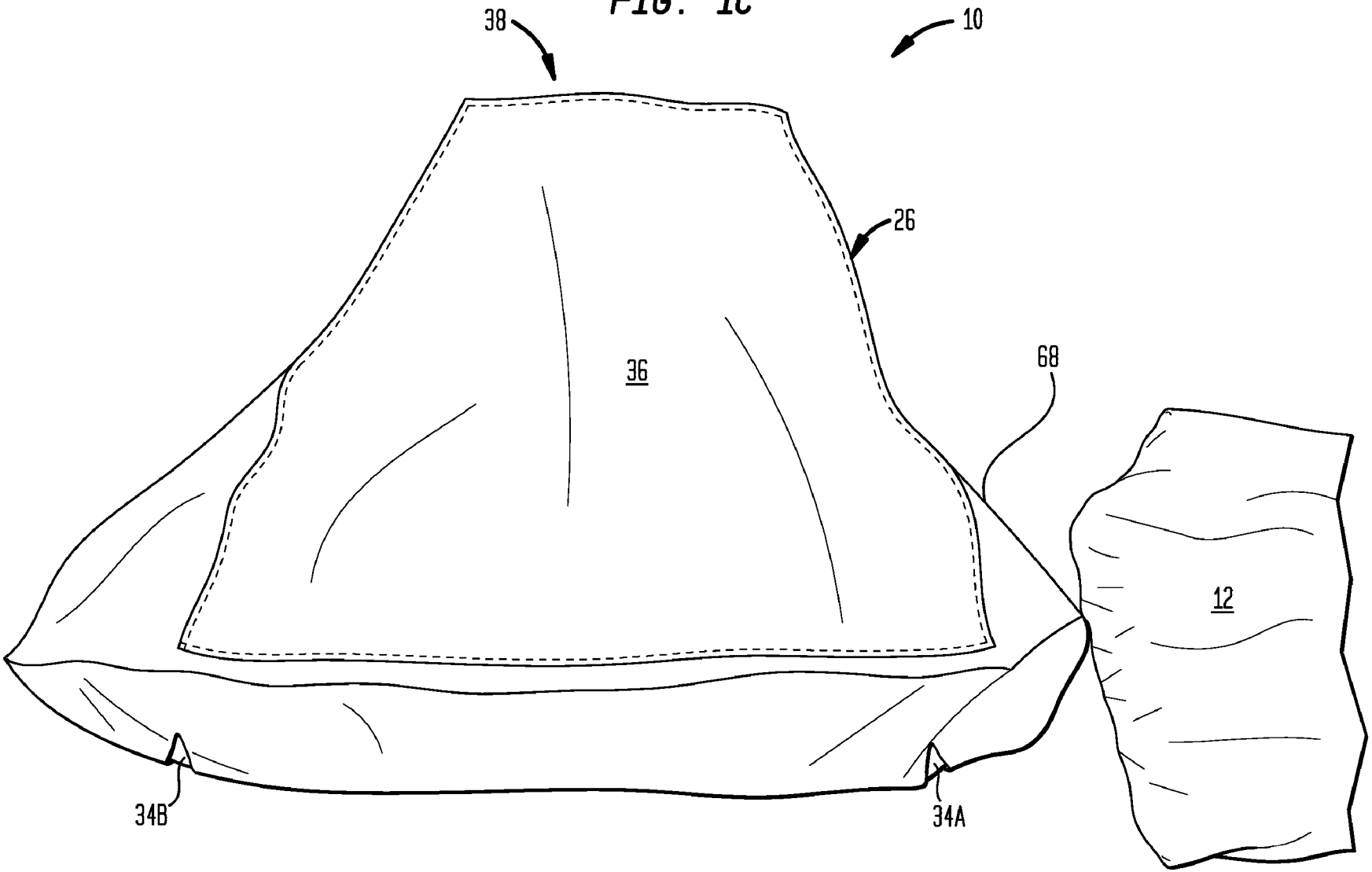
FIG. 1C is a front view of the preferred embodiment of the invention in its partially unfolded state showing, in particular, the rear pocket for storing the rolled up top section.
Figure 2A:
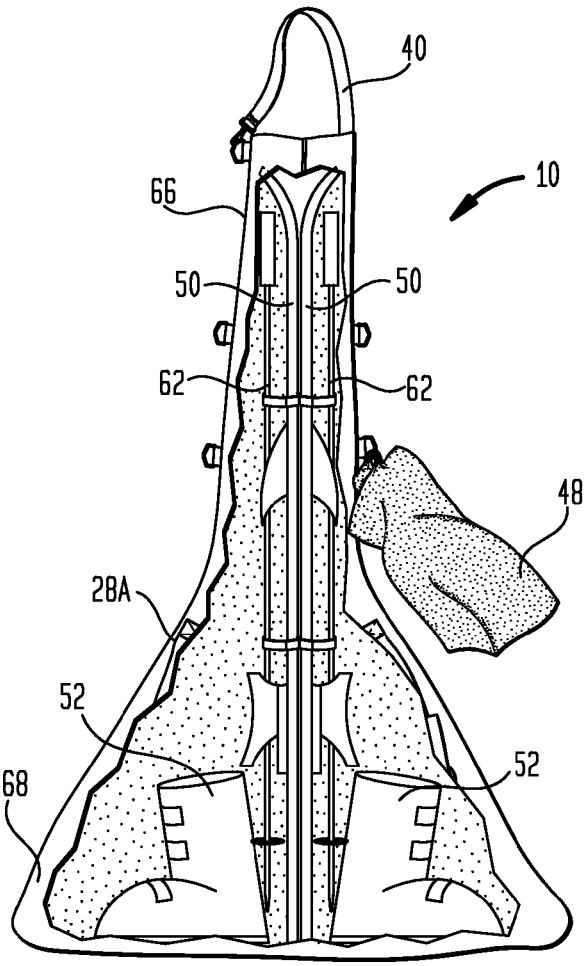
FIG. 2A is a partial cross-sectional view of the fully extended backpack showing the manner in which ski boots, ski poles and skis can be stored in the backpack.
Figure 2B:
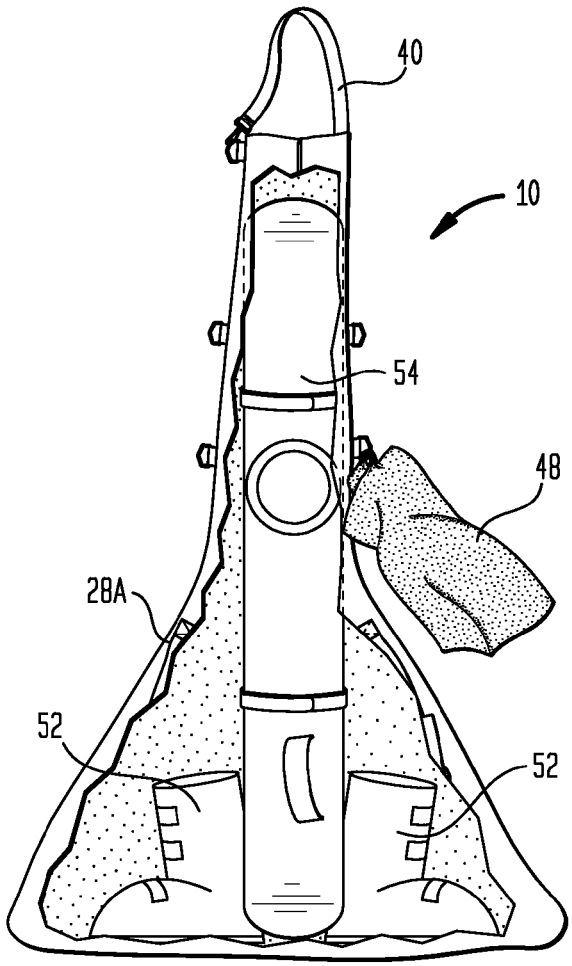
FIG. 2B is a partial cross-sectional view of the backpack used to carry ski boots or snowboard boots and a snowboard.

The front face of the bottom portion 68 is shown in FIG. 1C. A pocket flap 36 is sewn onto the outside front face of the base 68. Flap 36 includes an opening 38 at the top thereof. The purpose of opening 38 is so that the narrow top section 66 can be rolled up or folded into the pocket flap 36 when the backpack 10 is not being used to transport skis, ski poles, or snowboards. This permits the backpack 10 to be used as a normal backpack or just to transport ski boots 52 as shown in FIGS. 2A and 2B. Of course, additional items such as food, sodas, clothing, etc. can also be stored in the backpack 10 when it is in its partially folded mode 26 as shown in FIGS. 1*b* and 1*c*.

Figure 1D:
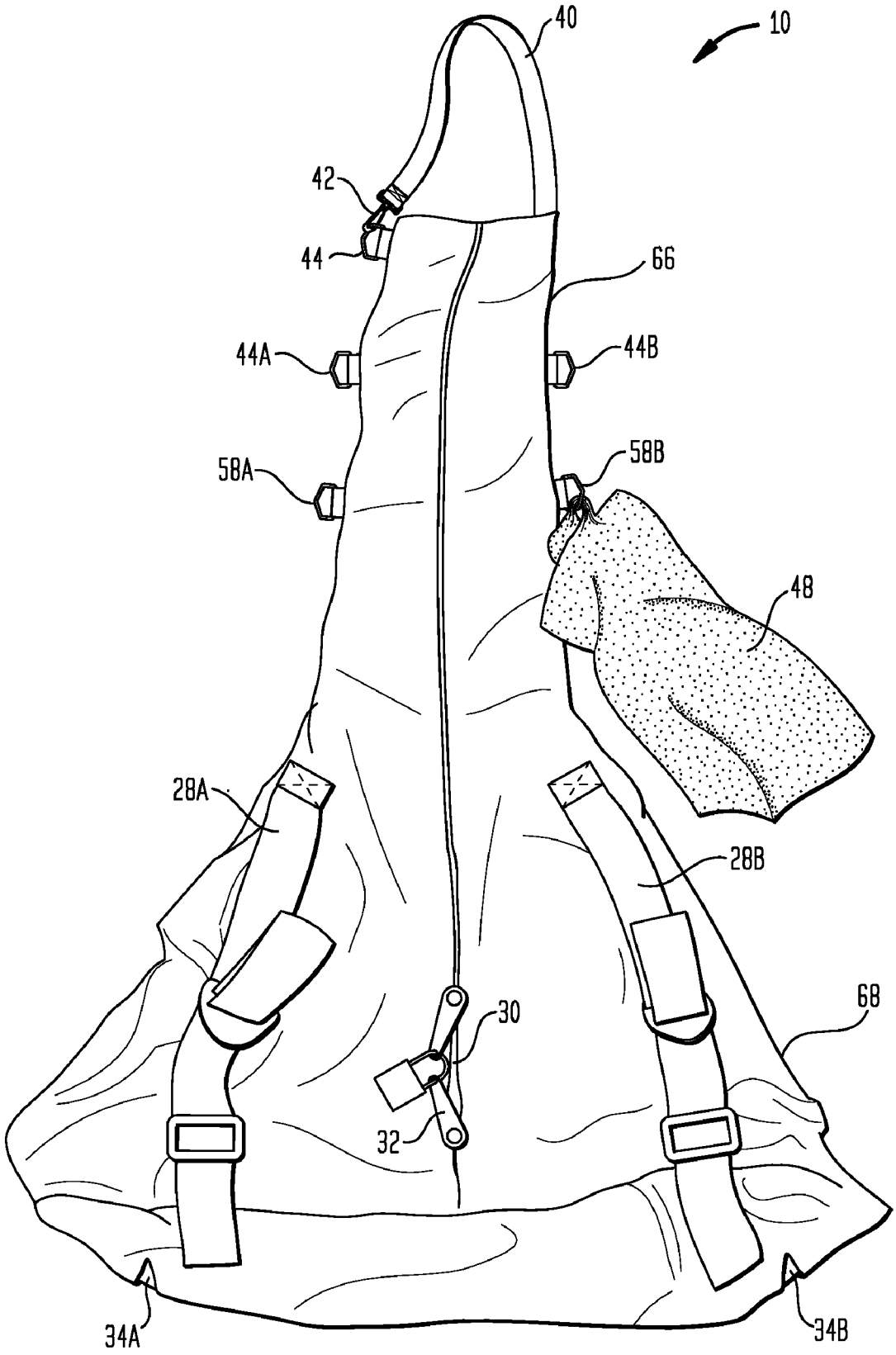
FIG. 1D is a rear view of the fully unfolded backpack with the upper, or top section, fully extended.
Figure 1E:
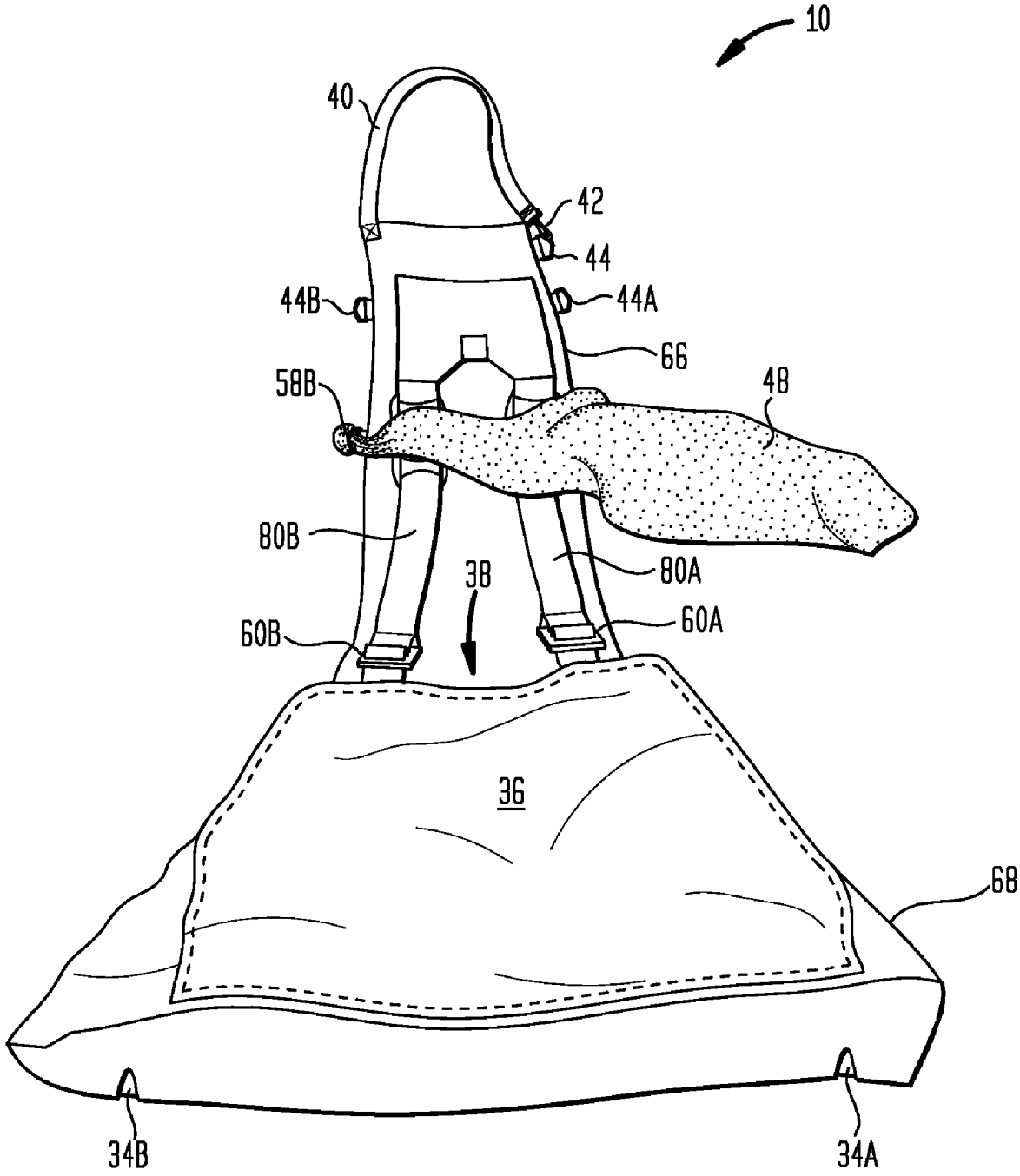
FIG. 1E is a front view of the backpack shown in the state illustrated in FIG. 1D.

The backpack 10 is shown in its fully unfolded mode in FIGS. 1D and 1E. The fully unfolded backpack 10 is shown in FIG. 1D from the rear. As shown in FIG. 1D, the unfolded backpack 10 includes a top hanging strap 40 attached by a clip 42 to a top D-ring 44. There are two sets of additional D-rings 44A and 44B, as well as 58A and 58B, located on opposite sides of the upper section 66. A towel 48, or other items such as a canteen, can be attached to the D-rings 44A, 44B, 58A, and 58B.

FIG. 1E illustrates the invention 10 in the fully unfolded state from the front thereof. In this state the upper section 66 has been unfolded and removed from the opening 38 in the pocket flap 36. A second set of backpack straps 80A and 80B shown attached to buckles 60A and 60B permit a child to carry the backpack 10 from the opposite side and when the backpack is fully extended.

FIG. 2A is a partial, cross-sectional view of the fully unfolded backpack 10 shown holding typical ski gear including skis 50, ski poles 62 and ski boots 52. Ski boots 52 fit comfortably within the wider bottom section 68. Similarly, the skis 50 and ski poles 62 fit comfortably in the narrower top section 66.

FIG. 2B is a partial, cross-sectional view of the backpack invention 10 shown carrying a snow board 54 instead of skis 50 and ski poles 62. Obviously, other types of ski equipment could be carried by the backpack 10 such as cross-country skis, etc.

FIGS. 3A and 3B illustrate how a child 56 might use the backpack invention 10. FIG. 3A shows the child 56 with the shoulder straps 80A and 80B over his shoulders. The backpack 10 is shown from the rear in a view similar to that of FIG. 1D. The backpack 10 is nicely balanced along the center of gravity of the child 56. Ideally the bottom of the backpack 10 extends to the backside of the knee of the child 56. That way the center of gravity of the backpack 10 is as low as possible without interfering with the child's legs as he or she walks.

The same child 56 is shown from the rear in FIG. 3B wherein the backpack 10 is seen from a perspective similar to that of FIG. 1E. One important feature of the invention is that the carrying and storage bag 12 doubles as a ski helmet carrying case. The ski helmet 64 is illustrated in phantom in FIG. 3B. Storage bag 12 is shown attached to the D-rings 58A and 58B by clips 22 as seen in FIG. 1A.

It is clear from the foregoing that the invention 10 comes in three states, namely: a folded up and stored state as seen in FIG. 1A, a partially unfolded state as shown in FIGS. 1B and 1C; and, a completely unfolded state as illustrated in FIGS. 1D, 1E, 2A, 2B, 3A, and 3B. In the partially unfolded state 26 as shown in FIGS. 1B and 1C, the backpack 10 can be used to convey many sorts of conventional materials, such as clothing, food, etc. much as any other backpack might be used. In the fully unfolded state illustrated in FIGS. 1D-3D, it operates as a very efficient backpack for children 56 so as to reduce strain, and let the child 56 safely take all of his or her equipment to the ski location.

In summary, the invention relates to a backpack 10, preferably for a child 56, which can also be used by adults, and which can accommodate skis 50, ski poles 62, ski boots 52 or snow boards 54, snowboard boots 52, and helmets 64, locks, gloves, goggles and other incidental ski items all in one backpack 10. When unloading ski gear at the car, the parent can have each of their children carry all their own ski equipment safely on his or her back. The ski backpack 10 has two sets of straps inside the backpack to secure the skis/snow board in place. With the backpack on, the child's hands would then be free to hold on to an adult's hand or a railing or ride a tram or transport wagon and the equipment would all be enclosed so as not to swing into other people or be dropped. When at the ski lodge, the backpack 10 can be hooked onto the outdoor ski racks by the strap 40 at the top of the bag 10, and the skis 50 can be unloaded. (Skis 50 are not usually allowed into the ski lodge where skiers go to put on their boots 52.) There is a zipper 30 which can be opened from the top and bottom of the bag 10 for easy access. Once the skis 50 are removed, the long narrow top part 66 of the bag 10 can be folded down into a pocket 36 on the back of the backpack 10. Then using the second set of straps 28A and 28A located on the front of the backpack, the child 56 can once again put the backpack 10 on and carry their boots 52 into the lodge. The backpack 10 would now contain the ski boots 52 and the smaller attached bag 48 still holds the helmet 64 and goggles. Once in the ski lodge, the child 56 can take out their ski boots and then store their snow boots in their ski backpack 10. The ski backpack 10 containing the child's boots 52 can then be stored in the ski lodge until they are finished skiing. Ski lodges provide lockers for storing gear which could hold the backpack 10, because the backpack 10 folds compactly. Also, many skiers leave their gear in the lodge under the tables and benches.

While the invention has been described with reference to the preferred embodiment thereof, it will be appreciated by those of ordinary skill in the art that modifications can be made to the elements and parts of the invention without departing from the spirit and scope of the invention as a whole.

I claim:

1. A backpack apparatus for carrying ski equipment, the backpack apparatus being foldable between a completely unfolded state, a partially folded state, and a folded up and stored state, said backpack apparatus comprising:

a bottom section;

a top section adjoining said bottom section, wherein said top section is longer and more narrow than said bottom section;

a flap attached to said bottom section, the flap and the bottom section forming a pocket having an open end facing toward the top section when the backpack apparatus is configured in a completely unfolded state, the pocket receiving the top section when the backpack apparatus is folded from the completely unfolded state to the partially folded state and the folded up and stored state;

a first set of shoulder straps attached to said bottom and top sections for engaging the shoulders of a user when the backpack apparatus is configured in the completely unfolded state; and a second set of shoulder straps attached to the bottom section on an opposite side of the backpack apparatus from the first set of shoulder straps for engaging the shoulders of the user when the backpack apparatus is configured in the partially folded state;

wherein skis or a snowboard can be housed entirely in said backpack apparatus when the backpack apparatus is configured in the completely unfolded state and when housed therein rest on said bottom section and extend from said bottom section into said top section.

2. The apparatus of claim 1 wherein said top and bottom sections are flexible and said apparatus further comprises: an opening through which said ski equipment can pass; and fastening means for selectively opening and closing said opening.

3. The apparatus of claim 1 further comprising: a storage bag for storing and transporting said backpack.

4. The apparatus of claim 3 wherein said apparatus further comprises: first attaching means connected to said top section; and, second attaching means connected to said storage bag for selective engagement with said first attaching mean, wherein said storage bag doubles as a helmet carrying bag when said storage bag is attached to said top section of said backpack apparatus.

5. The apparatus of claim 4 wherein said first attaching means comprises a pair of D-rings and wherein said second attaching means comprises a pair of snap clips for selective engagement with said D-rings.

6. The apparatus of claim 5 further comprising: a pair of drain holes in said bottom section for draining water from the inside of said backpack.

7. The apparatus of claim 1, further comprising a zipper providing access to an interior of the backpack apparatus, the zipper being accessible when the backpack apparatus is in the partially folded state and the completely unfolded state.

8. The apparatus of claim 1, wherein a width of the bottom section is minimum where the bottom section adjoins the top section, and increases along a length of the bottom section.

* * * * *